US009021631B2

(12) United States Patent
Miner

(10) Patent No.: US 9,021,631 B2
(45) Date of Patent: May 5, 2015

(54) DETACHABLE WATERPROOF PAD SYSTEM

(71) Applicant: Louise Miner, Ottawa (CA)

(72) Inventor: Louise Miner, Ottawa (CA)

( * ) Notice: Subject to any disclaimer, the term of this patent is extended or adjusted under 35 U.S.C. 154(b) by 0 days.

(21) Appl. No.: 13/688,657

(22) Filed: Nov. 29, 2012

(65) Prior Publication Data

US 2014/0143954 A1 May 29, 2014

(51) Int. Cl.
*A47G 9/00* (2006.01)
*A47C 31/10* (2006.01)

(52) U.S. Cl.
CPC ..... *A47C 31/105* (2013.01)

(58) Field of Classification Search
USPC ..... 5/417, 420, 484, 486, 495, 497, 498, 5/500, 502, 691, 692, 488, 737, 413 AM
See application file for complete search history.

(56) References Cited

U.S. PATENT DOCUMENTS

| | | | | | |
|---|---|---|---|---|---|
| 3,591,875 | A * | 7/1971 | Zipf et al. | 5/487 |
| 3,670,345 | A * | 6/1972 | Doll et al. | 5/484 |
| 3,761,973 | A * | 10/1973 | Leventhal | 5/484 |
| 4,097,943 | A * | 7/1978 | O'Connell | 5/484 |
| 4,241,466 | A * | 12/1980 | Mendyk | 5/497 |
| 4,627,122 | A * | 12/1986 | Hopp | 5/484 |
| 4,922,565 | A * | 5/1990 | Blake | 5/484 |
| 5,003,655 | A * | 4/1991 | Kafai | 5/496 |
| 5,010,610 | A * | 4/1991 | Ackley | 5/691 |
| 5,042,099 | A * | 8/1991 | Brenner et al. | 5/502 |
| 5,252,374 | A * | 10/1993 | Larsonneur | 428/77 |
| 5,685,257 | A * | 11/1997 | Feibus | 119/28.5 |
| 6,274,520 | B1 * | 8/2001 | Cordell | 442/381 |
| 6,312,051 | B1 | 11/2001 | Adams | |
| 6,381,778 | B1 * | 5/2002 | Peterson | 5/497 |
| 6,745,419 | B1 * | 6/2004 | Delfs et al. | 5/691 |
| 6,757,923 | B2 * | 7/2004 | Sopher et al. | 5/496 |
| 6,859,962 | B2 * | 3/2005 | Diak/Ghanem | 5/499 |
| 6,922,862 | B1 * | 8/2005 | Thompson | 5/691 |
| 7,120,952 | B1 | 10/2006 | Bass et al. | |
| 7,487,560 | B2 * | 2/2009 | McGrath et al. | 5/488 |
| 7,886,378 | B2 * | 2/2011 | Cheskis | 5/484 |
| 7,930,779 | B2 * | 4/2011 | Marrache | 5/498 |
| 8,151,386 | B2 * | 4/2012 | McKee | 5/500 |
| 8,464,657 | B1 * | 6/2013 | King | 119/28.5 |
| 8,656,534 | B2 * | 2/2014 | Canning | 5/484 |
| 2002/0053108 | A1 | 5/2002 | Goyarts | |
| 2002/0148047 | A1 * | 10/2002 | Corzani et al. | 5/738 |
| 2003/0172457 | A1 | 9/2003 | Pilling et al. | |
| 2004/0077243 | A1 | 4/2004 | Strongwater | |
| 2008/0083067 | A1 | 4/2008 | Wheeldon-Glazener | |
| 2008/0222805 | A1 | 9/2008 | Saunders | |
| 2009/0070932 | A1 | 3/2009 | Min | |
| 2010/0000019 | A1 | 1/2010 | Defranks et al. | |

(Continued)

FOREIGN PATENT DOCUMENTS

| | | | |
|---|---|---|---|
| CA | 2553942 | A1 | 1/2008 |
| CN | 101862098 | A | 10/2010 |

(Continued)

*Primary Examiner* — Nicholas Polito
*Assistant Examiner* — David R Hare
(74) *Attorney, Agent, or Firm* — Brion Raffoul

(57) ABSTRACT

Systems relating to a safe and easily removable and reusable waterproof pad with accompanying bottom layer that attaches to a crib mattress. The detachable waterproof pad of the present invention seeks to reduce the risk of sudden infant death syndrome (SIDS) by providing a tightly fitted pad to comply with current SIDS recommendations. The pad can be changed, cleaned, and replaced frequently.

14 Claims, 6 Drawing Sheets

(56) References Cited

U.S. PATENT DOCUMENTS

| | | | |
|---|---|---|---|
| 2011/0079330 | A1 | 4/2011 | Raine et al. |
| 2012/0167302 | A1 | 7/2012 | Malouf et al. |

FOREIGN PATENT DOCUMENTS

| | | | |
|---|---|---|---|
| CN | 201755030 | U | 3/2011 |
| JP | 11309183 | A | 11/1999 |
| KR | 20120028785 | A | 3/2012 |

* cited by examiner

DETACHABLE WATERPROOF PAD SYSTEM

FIELD OF THE INVENTION

The present invention relates to bed sheets and beddings for use in a crib.

BACKGROUND OF THE INVENTION

Mattress covers, sheets, or pads are widely used to cover a mattress. Covers, sheets, and pads come in a variety of styles and are used for several different purposes. Some offer extra cushioning and support to a sleeper, while others act as an extra layer, keeping the mattress itself cleaner.

Babies and other bedridden people can have trouble controlling their bowels or bladders and can soil the mattress or the top element of the mattress (i.e. the cover, sheet, and/or pad). Therefore, the top element of the mattress may need to be changed several times a day. This can be exhausting and time-consuming, considering the effort needed to arrange tightly fitted covers, sheets, and/or pads on the mattress.

In addition, the fit and design of the top element may be important depending on the user of the bed. For cribs, specific safety issues must be considered in the design. Recommendations for preventing sudden infant death syndrome (SIDS) are of primary importance. SIDS is the leading cause of death in the United States for babies between one month and one year old. SIDS is not any one illness or disease. Rather, it is the diagnosis given when a child under a year old dies suddenly and an exact cause cannot be found after a death scene investigation, an autopsy, and a review of the child's medical history are all undertaken. That SIDS can happen without warning makes it a particular source of insecurity for parents. Currently, approximately 2,300 infants die from SIDS in the United States each year. SIDS most commonly affects babies between the ages of one and four months, and ninety percent (90%) of cases involve infants younger than six months.

SIDS and other sleep-related infant deaths can be attributed to suffocation, asphyxia, entrapment, infection, ingestions, metabolic diseases, arrhythmia—associated cardiac channelopathies, and trauma (both accidental and non-accidental). The American Academy of Pediatrics (AAP) regularly publishes guidelines for infant sleep safety and SIDS risk reduction. The most recent guideline published Oct. 18, 2011 lists 18 recommendations. Relevant recommendations for the purposes of this document are cited below:

- Infants should be placed for sleep in a supine position (wholly on the back);
- A firm crib mattress, covered by a fitted sheet should be used;
- Soft objects or loose bedding should be out of the crib (including pillows, blankets, and bumper pads); and
- Covering the infant's head or overheating should be avoided.

In light of the risk of SIDS and the current recommendations, there are a number of aspects to consider when choosing a bedding element (pad, mattress, top sheet, bed cover, etc.). A thick or loose fitted cover, sheet, and/or pad may interfere with the breathing of a baby, especially if a baby's face presses against or is near these items. One should ensure that the pad or mattress fits properly in the crib. Any gaps or holes could pose a danger to a baby because airflow near and around the baby's head may be reduced. The crib pad or mattress should also be firm. A soft mattress can conform to the shape of a baby's head or face, increasing the risk of suffocation. One should also ensure that there is no loose bedding or any objects that could increase the risk of entrapment, suffocation, or strangulation within the crib.

Although the prior art provides useful waterproof covers for crib mattresses, they are not designed with the current SIDS recommendations in mind. For example, U.S. Pat. No. 4,922,565 discloses a crib sheet that consists of a moisture proof top panel and a lower panel that is attached to the mattress. The top panel and the lower panel are separable. Hook and loop fasteners attach the panels at only two sides, thereby leaving holes and gaps in which the baby's head or limbs can be caught. Although the prior art teaches that a bumper pad may be used to secure the top panel and close off any holes or gaps accessible to the baby, it should be noted that bumper pads are prohibited under any SIDS-related recommendations.

Therefore, there is a need for a safe, easily removable and reusable waterproof pad, which overcomes the shortcomings of the prior art.

SUMMARY OF INVENTION

The present invention provides systems relating to a currently safe and easily removable and reusable waterproof pad with an accompanying bottom layer that attaches to a crib mattress. The detachable waterproof pad of the present invention seeks to reduce the risk of sudden infant death syndrome by providing a tightly fitted pad to comply with current SIDS recommendations. The pad can be changed, cleaned, and replaced frequently.

In a first aspect, the present invention provides a detachable waterproof pad system for use in a crib, the system comprising:

- a bottom layer fitted sheet constructed and arranged to fasten around a mattress, the fitted sheet having a top surface adjoining a top surface of the mattress and a bottom surface adjoining a bottom surface of the mattress that is adjacent to a portion of a crib frame;
- a top layer pad constructed and arranged to cover a substantial portion of the top surface of the mattress, and having: a bottom waterproof layer, a middle absorbent layer, and a top fabric layer;
- first fastening means for operatively coupling the top layer pad to the bottom layer fitted sheet when the bottom layer fitted sheet is fastened to the mattress; and wherein the top layer pad is substantially immovable along the mattress due to the first fastening means being mounted at the edge of the pad along the bottom waterproof layer.

BRIEF DESCRIPTION OF THE DRAWINGS

The embodiments of the present invention will now be described with reference to the following figures, in which identical reference numerals in different figures indicate identical elements and in which.

The figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

The present invention provides replacements for both a crib's fitted sheet and a mattress pad. The waterproof nature of the pad protects the underlying mattress from potential soiling. If the pad is soiled, it is simply unfastened from the bottom layer, washed, and reused.

Figure 1:
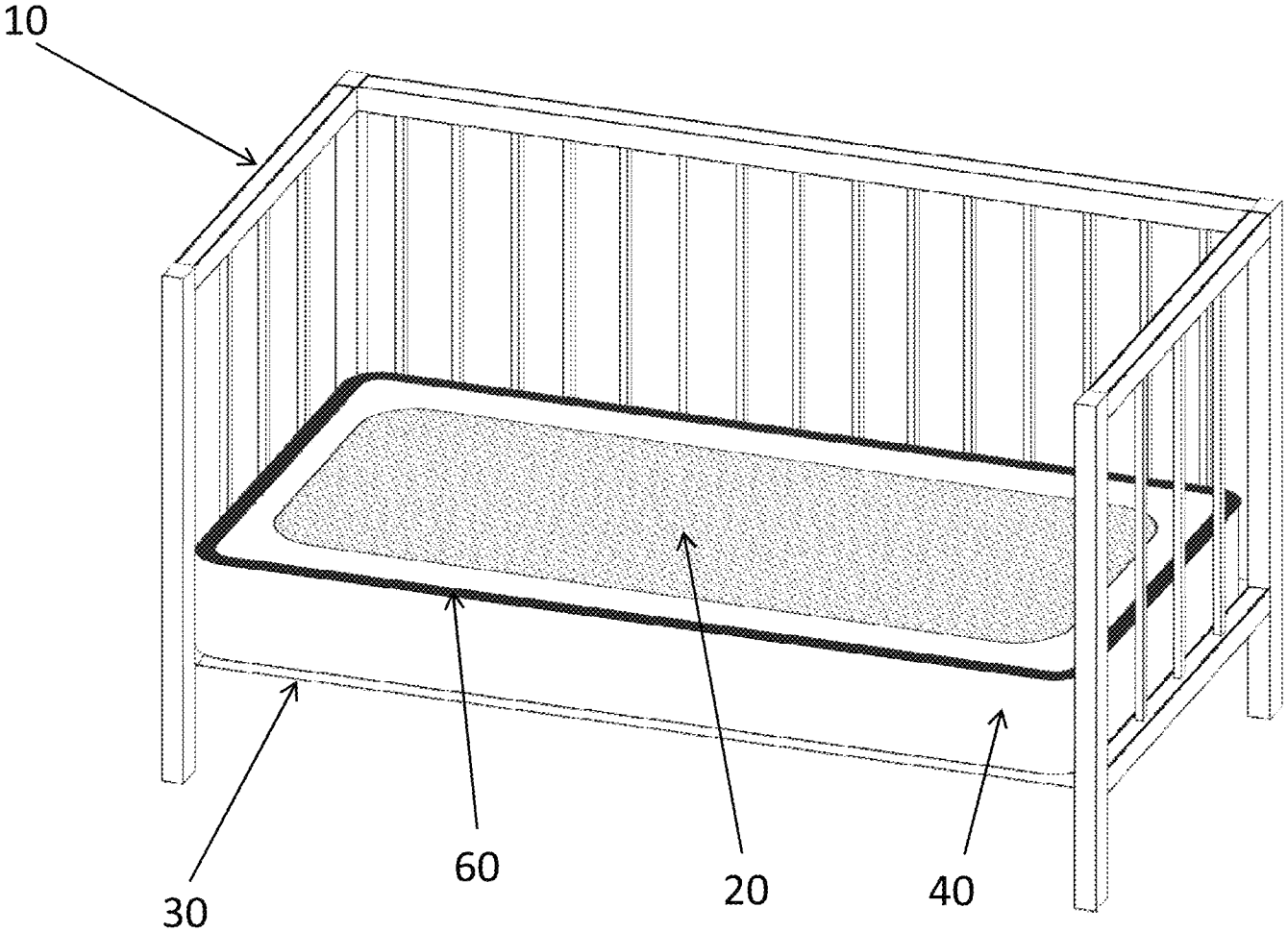
FIG. 1 is a perspective view of a fitted sheet bottom layer of a detachable waterproof pad system within a crib according to a first embodiment of the present invention.
Figure 2:
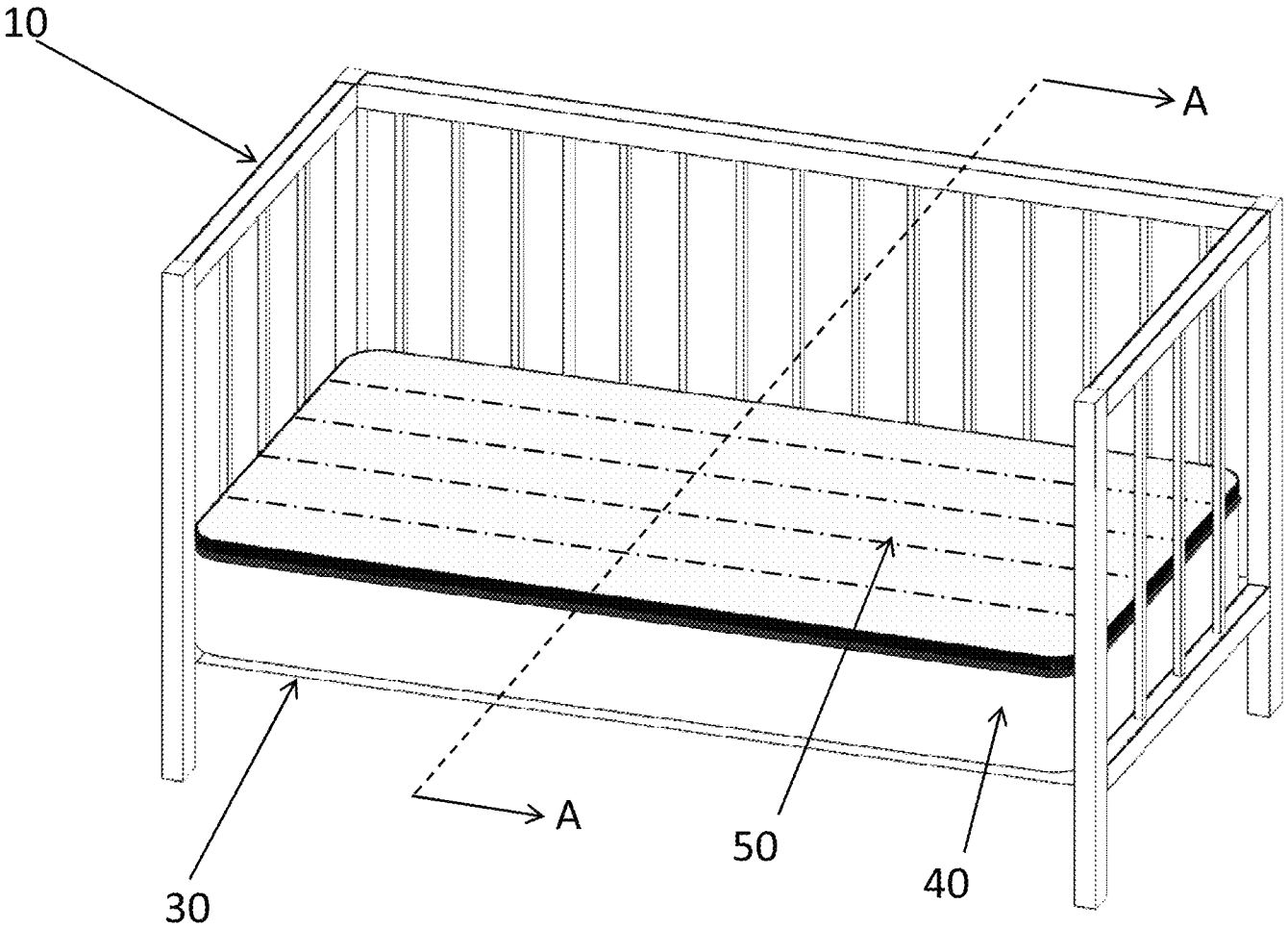
FIG. 2 is a perspective view of the detachable waterproof pad system according to a first embodiment of the present invention.
Figure 3:
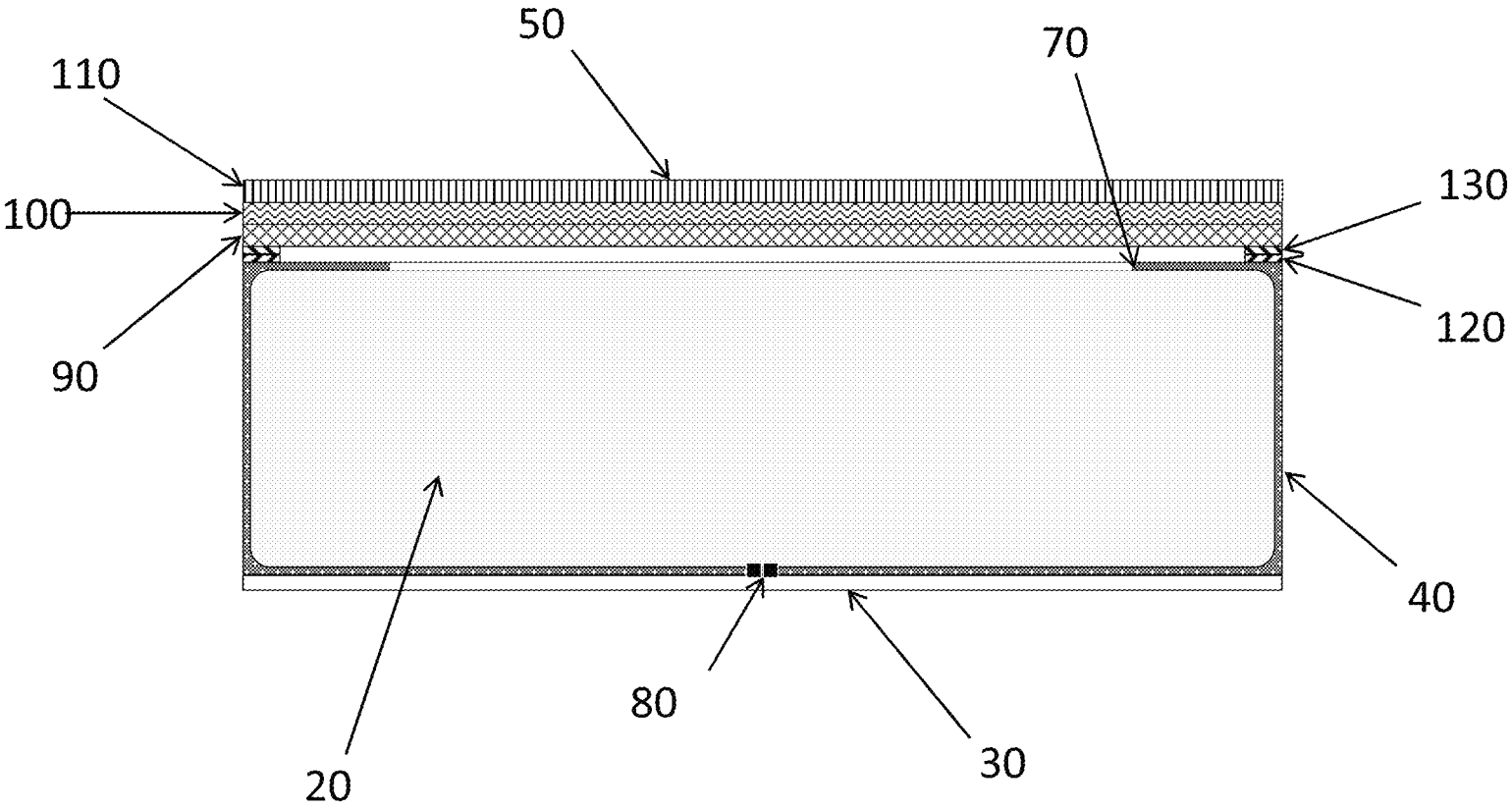
FIG. 3 is a cross-sectional view of the detachable waterproof pad system taken along line A-A of FIG. 2 according to a first embodiment of the present invention.

Referring to FIGS. 1 through 3, schematic representations of the detachable waterproof pad system are illustrated according to one embodiment of the present invention. FIGS. 1 through 3 illustrate one embodiment of the present invention where a fastening means has oval-shaped corners and is located at the edge of the mattress. In FIGS. 1 through 3, the top layer pad covers the entire top surface of the mattress and it has a non-continuous stitching pattern format.

Figure 4:
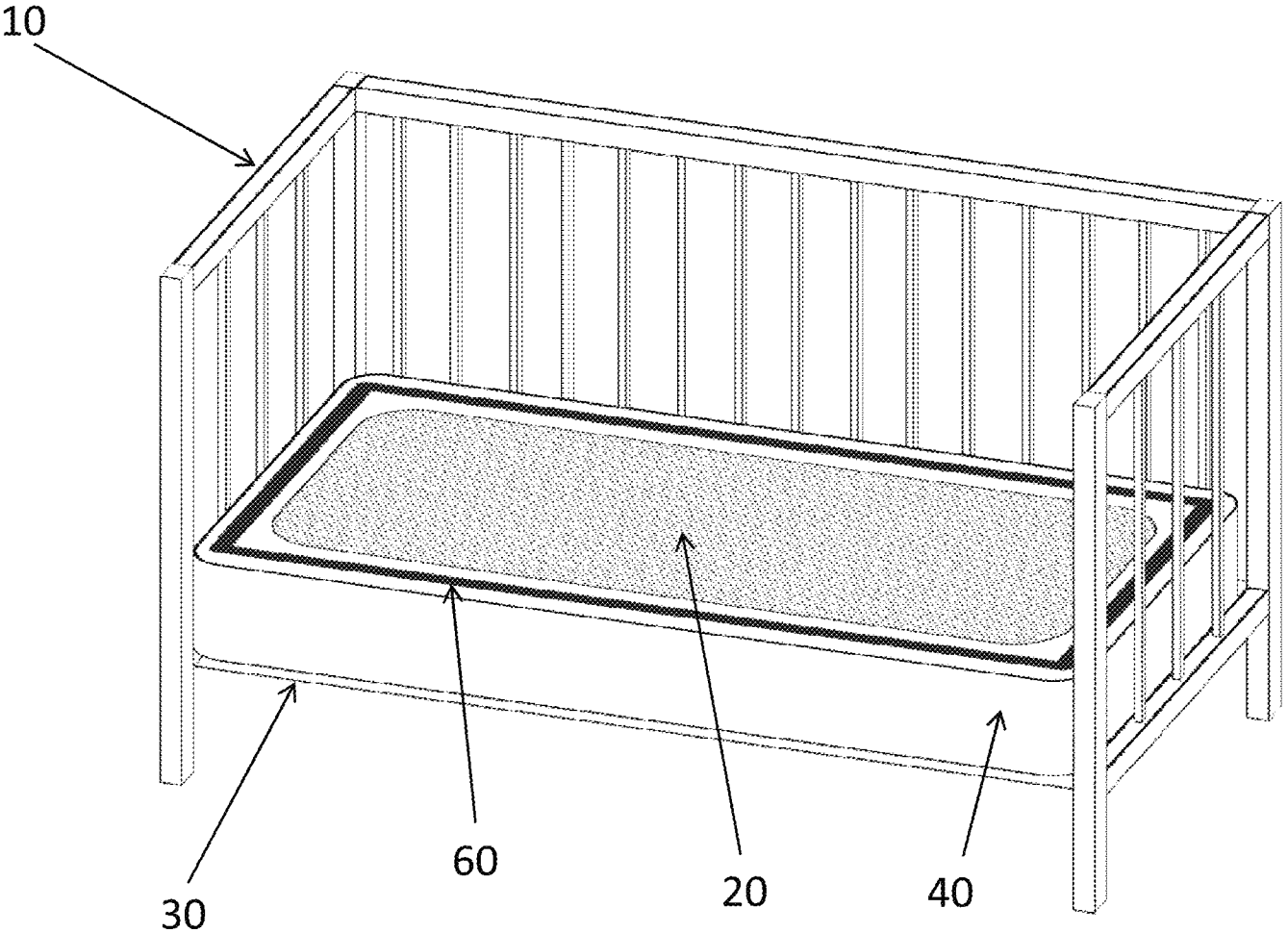
FIG. 4 is a perspective view of the fitted sheet bottom layer of the detachable waterproof pad system within a crib according to a second embodiment of the present invention.
Figure 5:
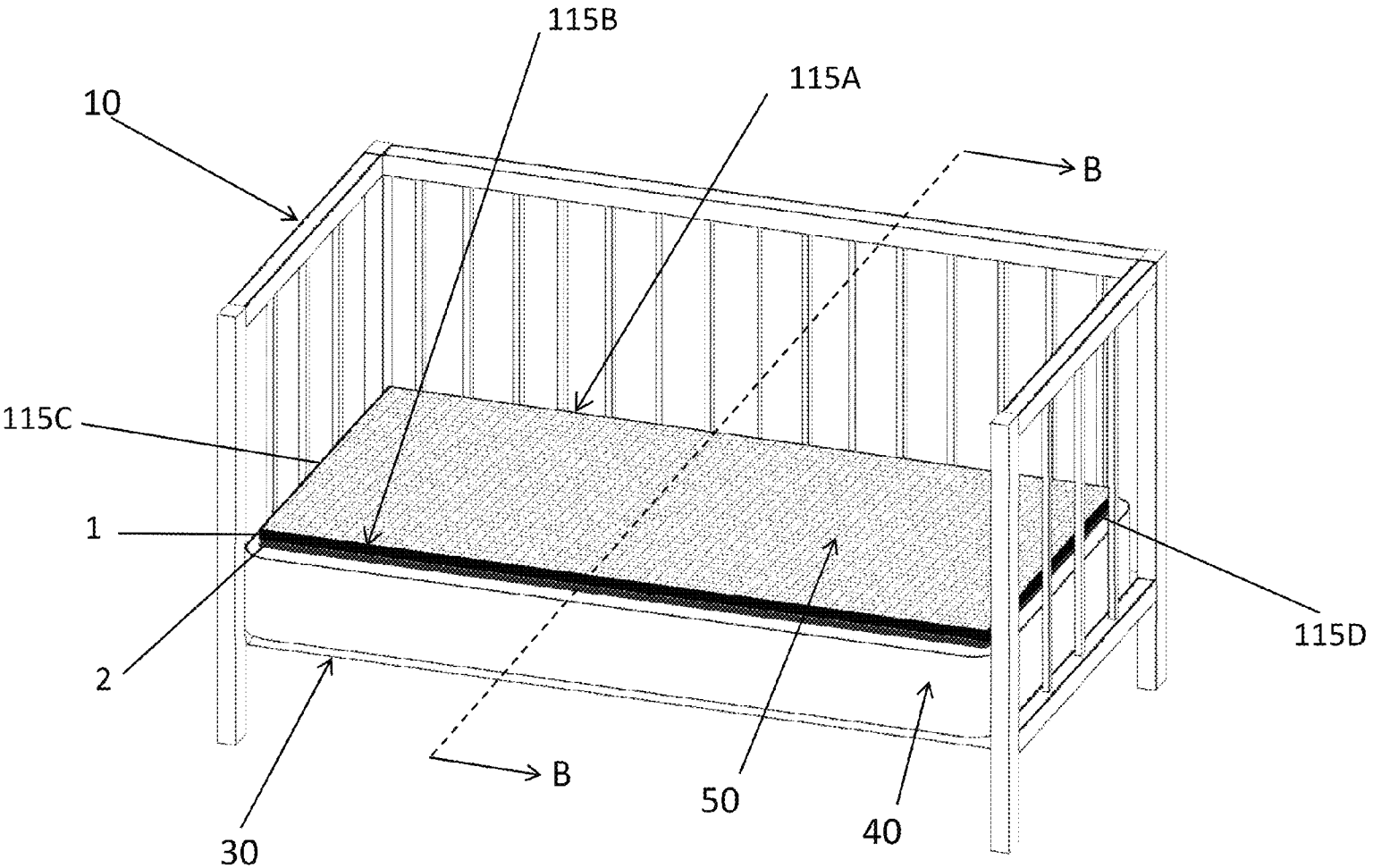
FIG. 5 is a perspective view of the detachable waterproof pad system according to second embodiment of the present invention.
Figure 6:
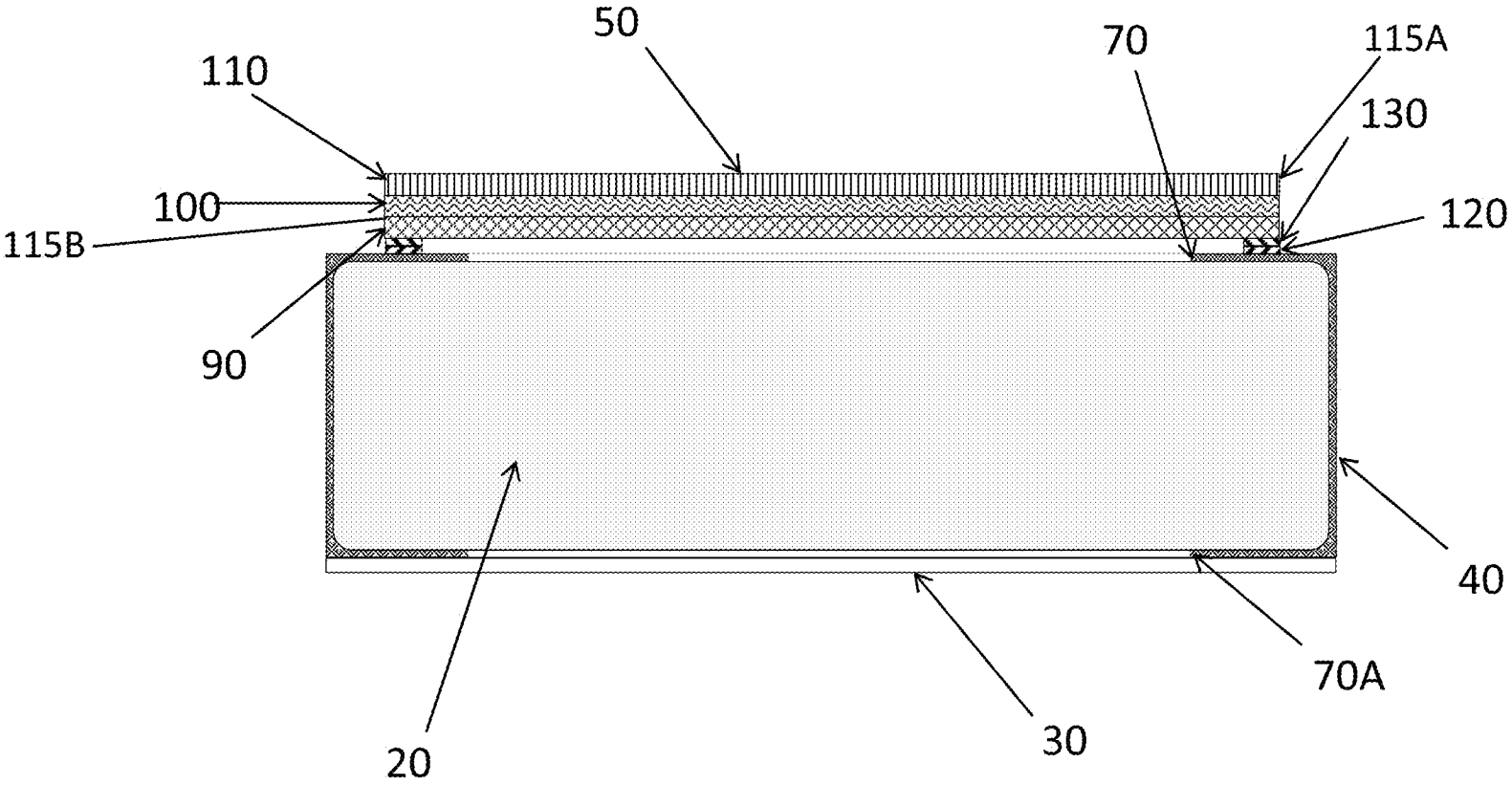
FIG. 6 is a cross-sectional view of the detachable waterproof pad system taken along line B-B of FIG. 5 according to a second embodiment of the present invention.

FIGS. 4 through 6 illustrate schematic representations of the detachable waterproof pad system according to another embodiment of the present invention. FIGS. 4 through 6 illustrate another embodiment of the present invention where a fastening means has a rectangular shape and is located away from the edge of the mattress. In FIGS. 4 through 6 the top layer pad covers a substantial portion of the top surface of the mattress and it has a continuous stitching pattern format.

Referring to FIG. 1, the detachable waterproof pad system is designed to be used in a crib 10 to cover a mattress 20 entirely or substantial portions thereof.

The mattress 20 in the crib 10 is generally supported by a frame 30.

The detachable waterproof pad system generally includes a bottom layer 40 and a top layer pad 50. The bottom layer 40 in FIG. 1 is a fitted sheet that covers the mattress 20. The bottom layer 40 in FIG. 1 only covers the sides of the mattress 20 and the mattress 20 can be seen in the void not covered by the bottom layer 40. The top layer pad 50 (shown in FIG. 2) is removably attachable to the bottom layer 40 by way of first fastening means 60. The first fastening means 60, in one embodiment, is a two-part fastening system with a bottom portion attached to the top surface of the bottom layer 40 and a top portion attached to the bottom surface of the top layer pad 50. The top and bottom portions of the first fastening means 60 cooperate to fasten the top layer pad 50 to the bottom layer 40 such that the top layer pad 50 does not move relative to the bottom layer 40. In the embodiment illustrated in FIG. 1, the bottom portion of the two-part fastening system is configured to cover the perimeter of the mattress 20. The complementary top portion of the two-part fastening system also covers the perimeter of the top layer pad 50 such that each section of the bottom portion on the top surface of the bottom layer has a corresponding top portion on the bottom surface of the top layer pad 50.

Referring to FIG. 2, another schematic presentation of the system illustrated in FIG. 1 is shown. The top layer pad 50 of the detachable waterproof pad system according to one aspect of the invention is shown. In the Figure, the top layer pad 50 is laid on top of the bottom layer 40 and on top of the mattress 20.

FIG. 3 is a cross-sectional diagram of the system illustrated in FIG. 2 along the lines A-A. It should be noted that, for simplicity, the cross section of most of the frame 30 is not shown in FIG. 3.

As can be seen in FIG. 3, the bottom layer 40 is a fitted sheet constructed and arranged to fasten around a crib mattress 20. The bottom layer of fitted sheet 40 has a top surface adjoining a top surface of the mattress 20 and a bottom surface adjoining a bottom surface of the mattress 20. The bottom surface of the mattress 20 is adjacent to a portion of a crib frame 10. In a preferred embodiment, the bottom layer 40 is equipped with a second fastening means for mounting the bottom layer fitted sheet around the top surface and around the bottom surface of the mattress 20. This second fastening means can be made of elastic bands. The second fastening means is deployed to hold the bottom layer tightly against the mattress 20.

In the embodiment illustrated in FIG. 3, the bottom layer 40 has second fastening means which include a unitary elastic band 70 around the top surface of the mattress and a zipper 80 for mounting the bottom layer fitted sheet 40 to the bottom surface of the mattress 20. Other fastening means for holding the bottom layer 40 tightly against the mattress 20 may also be used. Buttons, snaps, drawstrings and/or combinations of such fasteners may be employed. Buttons, snaps, drawstrings and/or combinations of such fasteners may be employed.

It should be noted that the bottom layer fitted sheet 40 can be made of any type of natural fabric material or synthetic fabric material. In the preferred embodiment, the material used is a polyester material to maintain greater durability in everyday use.

Again referring to FIG. 3, the top layer pad 50 of the detachable waterproof pad system can be constructed and arranged to entirely cover the top surface of the mattress 10 as well as the top surface of the bottom layer fitted sheet 40. The top layer pad 30 can have either rounded corners as shown in FIG. 2. The top layer pad 30 may consist of three layers, a bottom waterproof layer 90, a middle absorbent layer 100, and a top fabric layer 110. These layers form a substantially unitary article.

It should be noted that the height and the texture of the top layer pad 50 are important as having a pad which is too thick or too soft may cause suffocation. Therefore, the overall thickness of the top layer pad 50 is approximately 6 mm and is purposely stitched in a specific pattern format to ensure that the middle absorbent layer stays evenly distributed such that it remains at a constant height or thickness. These precautionary designs further reduce the risk of sudden infant death syndrome. It will be apparent to a person skilled in the art that the way the top layer pad 50 is sewn together or quilted can have a variety of stitching pattern formats to ensure that the middle absorbent layer stays evenly distributed. For example, sewn or quilted patterns, such as loops, diamonds, and squares, may be used. Furthermore, continuous or non-continuous stitching patterns may be used. FIG. 2 illustrates the use of a non-continuous stitching pattern.

The bottom waterproof layer 90 of the top layer pad 50 protects the underlying mattress 20 and fitted sheet 40 from potential soiling. The bottom waterproof layer 90 can be made of any type of water resistant or waterproof material at and is stitched only along its edges to the middle absorbent layer 100 and the top fabric layer 110, so as not to compromise the water resistance function and to prevent fluid from a user to leak to the underlying mattress 20 and/or fitted sheet 40. In the preferred embodiment, the material used is a waterproof tent fabric, such as a mixture of polyester with plasticized polyvinyl chloride (PVC-P).

The middle absorbent layer 100 of the top layer pad 50 serves the function of retaining soil or waste of a baby lying on the top layer pad 50. The middle absorbent layer 100 can be made of any type of natural or synthetic material that is fluid absorbent. In the preferred embodiment, the material used is a synthetic blend of polyester and viscose rayon.

The top fabric layer 110 is used to increase the comfort and aesthetic appeal for the user. The top fabric layer 110 can be made of the same material as the bottom layer fitted sheet 40 so that the color, texture, and design between the two matches and the appearance of the whole pad system can be eye-pleasing. Therefore, similar to the bottom layer fitted sheet 40, the top fabric layer 110 can be made of any type of natural fabric material or synthetic fabric material. In the preferred embodiment the material used is a polyester material to maintain greater durability in everyday use.

The top layer pad 50 can have an overall thickness of anywhere from ½ inch to ¼ inch. Other dimensions are, of course, possible.

Also illustrated in FIG. 3 are the bottom portion 120 and the top portion 130 of the two-part fastening system. As can be seen in FIG. 3, the two part fastening system is positioned to be at the very edge of the mattress 20 and the very edge of the top layer pad 50. This positioning ensures that, at their respective edges, there is no gap between the top layer pad 50 and the mattress 20 as the points of contact between the top layer pad 50 and the bottom layer 40 are covered by the first fastening means.

In a preferred embodiment, a hook and loop fastener means is used as the first fastening means to couple the top layer pad 50 to the bottom layer 40. The hook portion of the hook and loop fastener can be the bottom portion while the loop portion of the hook and loop fastener can be the top portion of the two-part fastening system. As can be imagined, the embodiment illustrated in FIGS. 1-3 uses strips of hook and loop fasteners or a continuous strip of hook and loop fasteners at each edge of the mattress 20.

The use of such a hook and loop fastener provides a substantially immovable sleeping arrangement for a baby and to further provide an easy removal and replacement padding system for parents. However, any other alternative fastening means known in the art may be used to provide tautness and a snug fit between the top layer pad 50 and the bottom layer 40. The first fastening means restrains the movement of the waterproof pad system while maintaining easy attaching and detaching mechanisms.

Referring to FIG. 4, an alternative embodiment of the detachable waterproof pad system is illustrated. As can be seen, the bottom portion of the first fastening means is positioned on the top surface of the bottom layer to not be at the very edge of the mattress 20. In this embodiment, the top portion of the first fastening means is correspondingly positioned at the bottom surface of the top layer pad.

Referring to FIG. 5, the alternative embodiment shows that the top layer pad 50 need not completely cover the mattress. As can be seen, the top layer pad 50 covers an area smaller than the top area of the mattress 20. The top portion of the first fastening means is positioned at the edge of the bottom of the top layer pad to cooperatively form a seal between the top layer 50 and the bottom layer 40 by way of the first fastening means.

FIG. 5 also shows the use of a continuous repeating square stitching pattern on the top layer pad 50 of the system. As noted above, other stitching patterns and designs may be used. FIG. 5 also clearly shows a unitary top layer pad 50 comprising a first section 1 including the to fabric layer 110 and the middle absorbent layer 100 stitched substantially throughout with the continuous repeating pattern, and the second section 2 stitched only along the edge of the perimeter so as not to compromise the water resistance function. In addition, FIG. 6 clearly shows a continuous line representing the stitching at edges 115A, 115B of the top layer pad 50, such that all four (4) edges (115A, 115B, 115C, 115D, shown in FIG. 5) of the top layer pad 50 are stitched to form a substantially unitary, article.

Referring to FIG. 6, a cross-sectional view of the system along lines B-B is illustrated. Similar to the embodiment illustrated in FIG. 3, the embodiment in FIG. 6 has a top layer pad 50 and the bottom layer 40 of the detachable waterproof pad system being releasably connected by a washable hook and loop fastener means. The top layer pad 50 has a top portion of the first fastening means 130 on the outer perimeter of the side facing downwardly and away from the waterproof layer 90 to operatively couple to the bottom portion of the first fastening means 120 on the bottom layer fitted sheet 40. The bottom portion of the first fastening means 120 can be located away from the top edge of the bottom layer 40 as illustrated in FIG. 6.

The top portion of the first fastener means 130 on the top layer pad 50 is intentionally mounted at the edge 115A of the top layer pad 50 along the bottom waterproof layer 90 to construct a substantially immovable top layer pad 50, and to prevent holes, gaps, or other openings in which the baby's head can be caught.

To releasably disengage the hook and loop fastener means of the present invention, one merely needs to place a finger between the bottom portion of the first fastening means 120 and the top portion of the first fastening means 130. These two portions are then pulled away from each other to disengage them from one another.

It should be noted that the embodiment illustrated in FIG. 6 differs from the embodiment in FIG. 3 in that the embodiment in FIG. 6 uses two unitary elastic bands as its second fastening means. The first unitary elastic band 70 is positioned at the top of the bottom layer along the perimeter of the void substantially spanning the top surface of the bottom layer fitted sheet, while the second unitary elastic band 70A is positioned at the bottom of the bottom layer 40. The unitary elastic band 70 around the top surface of the mattress mounts the bottom layer 40 to the top of the mattress 20 while the second unitary elastic band 70A mounts the bottom layer 40 to the bottom surface of the mattress 20. Other fastening means for holding the bottom layer 40 tightly against the mattress 20 may also be used. Buttons, snaps, drawstrings and/or combinations of such fasteners may be employed.

In a further preferred embodiment, the waterproof pad and/or the accompanying bottom layer can be cleaned and can be constructed to be able to withstand any ordinary washer and dryer.

A further advantage to the invention is that it allows for better airflow around and through the mattress. Previously, plastic layers or components were required for mattresses to be used by infants to protect against infant waste. Because the waterproof nature of the waterproof pad system already protects against this eventuality, mattresses for use by infants no longer need to have such plaster layers or components. The use of non-plastic layers or components in the mattress allows for better airflow and thereby prevents infants from overheating. It should be noted that the prevention of overheating in infants is one of the recommendations for preventing SIDS.

Although the illustrated detachable waterproof pad system is designed for use in a crib, the invention is useful on all bed sizes and can be manufactured in any desired size. Furthermore, it can be used on sofas, chairs, seats, and pillows.

A person understanding this invention may now conceive of alternative structures and embodiments or variations of the above all of which are intended to fall within the scope of the invention as defined in the claims that follow.

What is claimed is:

1. A detachable waterproof pad system for use in a crib, the system comprising:

a bottom layer fitted sheet constructed and arranged to fasten around a mattress, the fitted sheet having a top surface adjoining a top surface of the mattress, the top surface of the bottom layer fitted sheet having a void substantially spanning the top surface of the mattress and a bottom surface adjoining a bottom surface of the mattress that is adjacent to a portion of a crib frame;

a unitary top layer pad made of washable material and constructed and arranged to cover a substantial portion of the top surface of the mattress, and having: a bottom waterproof layer, a middle absorbent layer located above the bottom waterproof layer, and a top fabric layer located above the middle absorbent layer, each layer being of a substantially same dimension and where the top fabric layer and the middle absorbent layer are stitched together and throughout to ensure that the middle absorbent layer stays evenly distributed throughout the unitary top layer pad, and where the bottom waterproof layer is only stitched to the middle absorbent layer and the top fabric layer at all edges of the unitary top layer pad;

first fastening means for operatively coupling the unitary top layer pad to the bottom layer fitted sheet when the bottom layer fitted sheet is fastened to the mattress; wherein a top portion of the first fastening means is mounted along a first entire perimeter of a bottom portion of the bottom waterproof layer;

wherein a bottom portion of the first fastening means is mounted along a second entire perimeter of the top surface of the fitted sheet; and wherein the top layer pad is substantially immovable along the mattress when the top portion of the first fastening means is fastened to the bottom portion of the first fastening means.

2. The system according to claim 1, wherein the first fastening means is a hook and loop fastener.

3. The system according to claim 1, wherein the bottom layer fitted sheet has a second fastening means comprising elastic bands for mounting the bottom layer fitted sheet around the top surface and the bottom surface of the mattress.

4. The system according to claim 1, wherein the bottom layer fitted sheet has a second fastening means comprising a unitary elastic band around the bottom surface of the mattress.

5. The system according to claim 1, wherein the bottom layer fitted sheet has a second fastening means comprising a zipper for mounting the bottom layer fitted sheet to the bottom surface of the mattress.

6. The system according to claim 1, wherein the top layer pad has a thickness of approximately 6 mm.

7. The system according to claim 1, wherein the stitching is made of a pattern selected from a group consisting of loop, diamond, and square.

8. The system according to claim 1, wherein the stitching has a continuous pattern.

9. The system according to claim 1, wherein the stitching has a non-continuous pattern.

10. The system according to claim 1 wherein the bottom layer fitted sheet is made of a material selected from a group consisting of polyester, rayon, wool, cotton, and a mixture of any of the above materials.

11. The system according to claim 1, wherein the bottom waterproof layer is made of rubber based material.

12. The system according to claim 1, wherein the bottom waterproof layer is made of plastic based material.

13. The system according to claim 1, wherein the middle absorbent layer is made of a material selected from a group consisting of polyester, polyurethane, viscose, rayon, and a mixture of any of the above materials.

14. The system according to claim 1, wherein the top fabric layer is made of a material selected from a group consisting of polyester, rayon, wool, cotton, and a mixture of any of the above materials.

* * * * *